United States Patent [19]

Webb et al.

[11] 4,425,131

[45] Jan. 10, 1984

[54] METHOD OF IMPROVED PILE APPEARANCE IN LIQUID AMMONIA TREATED FABRIC; PRETREATMENT WITH CREASE RESISTANT RESIN

[75] Inventors: Harry A. Webb, Menands; Jackson Lawrence, Troy, both of N.Y.

[73] Assignee: Cluett, Peabody & Co., Inc., New York, N.Y.

[21] Appl. No.: 513,949

[22] Filed: Jul. 15, 1983

Related U.S. Application Data

[63] Continuation of Ser. No. 391,609, Jun. 24, 1982, abandoned, which is a continuation of Ser. No. 149,840, May 14, 1980, abandoned, which is a continuation of Ser. No. 17,195, Mar. 5, 1979, abandoned.

[51] Int. Cl.[3] ..... D06M 1/02; D06M 15/16

[52] U.S. Cl. ..... 8/115.6; 8/115.5; 8/116 R; 8/125; 8/182

[58] Field of Search ..... 8/115.6, 115.5, 116 R, 8/125, 182

[56] References Cited

U.S. PATENT DOCUMENTS

| | | | |
|---|---|---|---|
| 3,457,025 | 7/1969 | Barber et al. | 8/115.6 |
| 3,511,591 | 5/1970 | Webb | 8/116 R |
| 3,521,995 | 7/1970 | Smith | 8/113 |
| 3,542,503 | 11/1970 | Kullman et al. | 8/116 R |
| 3,849,067 | 11/1974 | Calamari et al. | 8/115.7 |

OTHER PUBLICATIONS

Evans, S. M. and R. Jeffries, J. Applied Polymer Science, 1970, 14, pp. 655–665.

*Primary Examiner*—A. Lionel Clingman
*Attorney, Agent, or Firm*—James F. Bryan

[57] ABSTRACT

The method of pretreating pile fabrics with resin at relatively low percentage levels in order to stabilize the appearance (pile shrinkage and distortion) of the pile as affected by a subsequent treatment with liquid ammonia.

1 Claim, No Drawings

METHOD OF IMPROVED PILE APPEARANCE IN LIQUID AMMONIA TREATED FABRIC; PRETREATMENT WITH CREASE RESISTANT RESIN

RELATED APPLICATIONS

This application is a continuation of my prior copending application Ser. No. 391,609 filed June 24, 1982 which in turn was a continuation of my earlier copending application Ser. No. 149,840 filed May 14, 1980 which is a continuation of Ser. No. 017,195 filed Mar. 5, 1979, earlier applications being now abandoned.

BACKGROUND OF THE INVENTION

In order to achieve a high level of durable press characteristics for some cotton fabrics, it has been necessary to treat such fabrics with a resin, such as formaldehyde, in the order of 5%–10% by weight. Such treatments invariably weaken the tensile strength of the fabric, particularly in the filling direction. In recent years, commercialization of a process for the liquid ammonia treatment of cotton fabrics has become an accomplished fact. In such treatment, the "hand" and wrinkle resistance of cotton fabrics is improved, imparting at least in the heavier fabrics a durable press effect. Such treatment also improves the tensile strength of the fabric and is commonly used in conjunction with a subsequent resin treatment of medium and lightweight fabrics in order to achieve a high level of durable press characteristics, while negating to a large extent the weakening effect of the resin treatment upon the fabric.

A special problem is presented when a pile fabric such as corduroy or velvet is treated according to known methods for durable press purposes. When an untensioned fabric is immersed in liquid ammonia, shrinkage occurs which can exceed the washing shrinkage by two or three times. This excessive shrinkage is normally controlled by applying tension to the fabric or by combined time and tension control. When pile fabrics such as corduroy or velvet are treated with liquid ammonia, the pile on such fabrics shrinks excessively since it is attached at one end only and hence is tensionless (the pile being freestanding and attached to the base fabric).

Additionally, during the drying of an ammonia saturated fabric at a specified level of residual ammonia, the fabric becomes easily distorted. Since many existing commercial ammonia finishing ranges utilize blanketed cylinders for fabric drying, the normal pressure of the blanket against the fabric distorts and flattens the pile. It is the purpose of the present invention to disclose a method of treatment combining resin treatment and liquid ammonia treatment of pile fabrics in such a manner as to minimize the problems of pile shrinkage, flattening and distortion which greatly improves the appearance of such pile fabrics.

SUMMARY OF THE INVENTION

In the liquid ammonia treatment which is preferably used, shrinkage of the fabric in the warp direction is minimized by applying tension and shrinkage in the filling direction is minimized by a combination of tension and limiting the time of treatment. Shrinkage of the filling threads is also inhibited by the fact that as these threads shrink they are restrained by their inter-relationship with the warp threads. However, in the case of a pile fabric, the pile does not have such restraint with respect to shrinkage since it is attached at only one end to the base fabric. Consequently during liquid ammonia treatment, the pile tends to be distorted by such treatment in appearance; that is to suffer randomization, shrinkage, and flattening effects.

In accordance with the present invention such effects are greatly minimized by treating the pile fabric with a resin, such as a durable press resin, curing said resin and following such treatment with the liquid ammonia treatment. Beneficial effects of the type mentioned are observed within the range of approximately 2% to 10% resin by weight of fabric. Ideally 6% is indicated and a preferred range maybe 4% to 8%. If additional resin is required for greater durable press, this can be applied subsequent to the liquid ammonia treatment.

DESCRIPTION OF A PREFERRED EMBODIMENT OF THE METHOD OF THE Invention

The present method minimizes the problems of pile shrinkage and distortion of a pile fabric to be treated with liquid ammonia by applying to the pile fabric and curing a light resin finish prior to the liquid ammonia treatment. If resin levels of the order of 4%–8% by fabric weight are applied and cured on the fabric prior to liquid ammonia treatment, significant improvements in retention of appearance are demonstrated. The resin chosen will be one ordinarily used for imparting durable press characteristics, such as one of the known formaldehyde-based resins. If needed for achieving additional durable press effect, additional resin can be applied after the liquid ammonia treatment.

Any conventional method of applying resin to pile fabrics may be chosen so long as the technique employed does not cause distortion of the pile. For example, resin may be applied by a coating roller, by foaming technique or by dipping in a padder. In the latter instance, after the excess resin is removed by squeezing, the pile would be brushed to cause it to recover its initial appearance prior to curing.

In accordance with the present invention, it has been discovered that by restricting the shrinkage and randomization effects of the liquid ammonia treatment, it is possible to greatly reduce the adverse effect of such treatment on the appearance of a pile fabric. For example, where such a fabric is corduroy, ideally after treatment by liquid ammonia and resin, the appearance of the pile should be essentially the same as when conventionally finished. Even though it has been found that some of the pile distortion (flattening, shrinkage and randomization) can be reversed by washing and tumble drying, it is extremely important that the appearance of say corduroy or other pile fabrics be essentially maintained when such fabric emerges from commercial treatment. Heretofore, with the normal sequence of first treating the fabric with liquid ammonia and following such treatment with a resin finish, the effects of the liquid ammonia treatment were highly deleterious with respect to the appearance of the pile.

The following table illustrates the effect of various treatments upon four samples in comparison with the first sample ("as received"):

| SAMPLE | APPEARANCE | BREAKING STRENGTH IN POUNDS PER INCH OF FABRIC WIDTH W | F |
|---|---|---|---|
| As Received | 3.3 | 95 | 53 |
| $NH_3$ | 3.5 | 105 | 60 |
| 6% Resin | 3.7 | 93 | 45 |
| $NH_3$ + 6% Resin | 3.7 | 97 | 53 |
| 6% Resin + $NH_3$ | 3.8 | 93 | 49 |

From the above table, certain conclusions can be drawn. Each of the samples were taken from the same lot. Appearance was judged in accordance with the AATCC (American Association of Textile Chemists and Colorists) method for durable press wherein a scale of 1 to 5 is possible. On this scale, a rating of 2.0 is the lower limit of commercial acceptance, and a rating of 4.0 would correspond to a typical smooth finish, perhaps polyester/cotton blend sheeting which is relatively wrinkle free. It can be observed from the table, therefore, that when the samples were treated with liquid ammonia, the appearance improved somewhat. Treatment with 6% resin and treatment with $NH_3$+6% resin provided another gain and improvement at the same level. The best rated appearance resulted from a preresin treatment of 6% followed by a liquid ammonia treatment. This latter treatment begins to cause the fabric to begin to approach the smooth, relatively wrinkle free appearance.

The column entitled "Breaking Strength in Pounds Per Inch of Fabric Width" illustrates the varying effects of the different treatments in terms of tensile strength in the warp (W) and in the filling (F) direction. While warp strength remained very constant, it can be seen that treatment with liquid ammonia improved the original tensile strength from a value of 53 to a value of 60, while treatment with 6% resin alone reduced tensile strength to a value of 45. Liquid ammonia treatment followed by 6% resin resulted in a value identical to that of the original untreated fabric, while 6% resin treatment followed by treatment with liquid ammonia produced a value of 49, which was lower by less than 10% the value of the untreated fabric, and therefore quite acceptable.

The second table which follows illustrates the effect of the same treatments in terms of shrinkage:

| | Resin | | $NH_3$ | | Resin | |
|---|---|---|---|---|---|---|
| | W | F | W | F | W | F |
| As Recieved | | | | | | |

-continued

| | Resin | | $NH_3$ | | Resin | |
|---|---|---|---|---|---|---|
| | W | F | W | F | W | F |
| $NH_3$ | | | 3.4 | 6.8 | | |
| 6% Resin | | | | | .8 | 1.5 |
| $NH_3$ + 6% Resin | | | 3.5 | 6.9 | .9 | 0 |
| 6% Resin + $NH_3$ | 1.3 | 2.6 | 3.5 | 3.4 | | |

With reference to the above table, as expected, treatment of the corduroy samples by liquid ammonia alone produced expected shrinkage levels respectively in the warp and filling direction. These were shrinkage of 3.4% and 6.8% respectively. These values were essentially mirrored by the treatment with liquid ammonia followed by 6% resin. However, significantly and importantly, when the sample was first treated with 6% resin, followed by liquid ammonia, shrinkage in the warp and filling directions were essentially the same.

The effects observed quantitatively in the above tables taken in conjunction with a qualitative visual comparison of the respective samples for distortion in appearance argues very strongly that where pre-resin treatment of the fabric is followed by liquid ammonia treatment shrinkage caused by the liquid ammonia is restricted and minimized, and distortion of the pile itself is minimized. Thus, a superior appearance for point of sale results. Although as indicated the results presented in the above tables were based upon the use of a 6% by weight of fabric resin treatment, other tests within the range of approximately 2% to approximately 10% have indicated that similar beneficial results occur. A preferred range for such results is 4% to 8%.

It should be understood that the foregoing description has been of a particular embodiment, and is therefore merely representative. In order to understand fully the scope of the invention, reference should be made to the appended claims.

We claim:

1. The method of effecting liquid ammonia treatment of a pile fabric, said fabric having a base portion having at least a partial content of cotton and having a free standing pile having at least a partial content of cotton, without excessive distortion of the pile fibers during such treatment, which comprises (a) initially treating at least the pile fibers of said fabric with a durable press resin to impart to said pile fibers about 2% to about 8% of said resin by weight of the fibers being treated, (b) curing said resin, (c) thereafter subjecting said fabric to treatment in a liquid ammonia bath, (d) controlling shrinkage of said fabric in warp and filling directions at least in part by the application of tension to said fabric, and (e) controlling shrinkage and distortion of said pile fibers by means of said cured durable press resin.

* * * * *